US006843088B1

(12) United States Patent
Kruger et al.

(10) Patent No.: US 6,843,088 B1
(45) Date of Patent: Jan. 18, 2005

(54) RAISED SURFACE FEATURES FOR HOT BLOW-FORMING TOOLING

(75) Inventors: Gary A. Kruger, Troy, MI (US); Mark G. Konopnicki, Rochester, MI (US); Chongmin Kim, Bloomfield Township, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/779,362

(22) Filed: Feb. 13, 2004

(51) Int. Cl.[7] ..... B21D 26/02

(52) U.S. Cl. ..... 72/57; 72/60; 72/340; 29/421.1

(58) Field of Search ..... 72/340, 352, 60, 72/57, 58; 29/421.1

(56) References Cited

U.S. PATENT DOCUMENTS 3,435,654 A * 4/1969 Papst ..... 72/340
3,530,699 A * 9/1970 Uberbacker ..... 72/60
5,920,981 A * 7/1999 Bushelle et al. ..... 72/340
6,253,588 B1 * 7/2001 Rashid et al. ..... 72/57
2004/0079129 A1 * 4/2004 Krajewski et al. ..... 72/60

* cited by examiner

*Primary Examiner*—David Jones
(74) *Attorney, Agent, or Firm*—Kathryn A. Marra

(57) ABSTRACT

Apparatus and method for hot blow-forming an article from a blank of sheet metal. Simultaneously, a surface of the blank of sheet metal is formed against a form tool body that partially defines a forming surface and against a form tool insert that also partially defines the forming surface and that is positioned within a recess of the form tool body such that a lateral gap is defined between the form tool insert and form tool body. Opposed projections are provided on upper surfaces of the form tool insert and the form tool body adjacent the gap. The projections create a raised portion on the sheet metal panel that corresponds to the gap. The raised portion is removed flush with respect to a visible surface of the article.

13 Claims, 2 Drawing Sheets

RAISED SURFACE FEATURES FOR HOT BLOW-FORMING TOOLING

TECHNICAL FIELD

The present invention generally pertains to hot blow-forming of metal alloy sheet blanks into articles of complex curvature such as automotive body panels. More specifically, this invention pertains to hot blow-forming tooling having adjacently disposed tool elements with raised surface features to counteract draw-in of sheet material into gaps between the tool elements.

BACKGROUND OF THE INVENTION

Sheet metal articles can be made by hot blow-forming processes that use complementary forming tools in a press under the pressure of a working gas to stretch-form a preheated sheet metal blank against forming surfaces on the forming tools. Such processes are particularly applicable to forming sheet metal into products of complex three-dimensional curvature. For example, superplastic-forming (SPF) and quick-plastic-forming (QPF) processes are increasingly being used to produce high quality sheet metal products such as automotive body panels. One such process is disclosed in U.S. Pat. No. 6,253,588, entitled "Quick Plastic Forming of Aluminum Alloy Sheet Metal" to Rashid et al., which is assigned to the assignee hereof and which is incorporated by reference herein.

In hot blow-forming, a hot metal sheet is blown against a heated forming surface. Because the sheet is hot, it is quite compliant and takes the shape of the forming surface. Accordingly, SPF and QPF processes are capable of producing automotive body panels with a high degree of resolution with complex shapes and fine surface details.

But, such resolution capability also yields some unintended qualities. For example, surface show-through discontinuities appear when the sheet metal blank is stretch-formed against discontinuities in the forming surfaces on the forming tools. Show-through is the obtrusive communication of surface discontinuities from one side of the sheet metal blank to the other. Such discontinuities are particularly noticeable when the show-through occurs on a Class A surface, which may be generally defined as a surface on a final product that is readily visible to a customer. The sources of show-through and other surface blemishes are many, including uneven lubrication between a sheet metal blank and a tool, contamination or debris on tool surfaces, hair-line cracks in welded zones on tool surfaces, boundaries between an insert and a tool, and gaps between tool elements. The first three sources mentioned above can usually be eliminated by exercising care in maintaining the tooling and equipment. The last two sources mentioned above, however, are impossible to eliminate with maintenance.

Forming tools and forming surfaces thereof may have distinct elements, such as die inserts positioned with a die body for forming special features of the sheet, or lift pads to remove a formed sheet while it is still hot. There may be gaps or discontinuities at the forming surface between adjacent surfaces of the inserts and the body. The gaps are typically on the order of about millimeter and the hot sheet tends to sag into the gap under the pressure of the working gas. This shows up as a depression on a visible surface of the formed part.

To illustrate, FIG. 6 shows a QPF tooling apparatus 10 for forming a workpiece W, wherein the apparatus 10 includes lateral gaps between moving tool elements. The apparatus

10 includes an upper flask tool 12 disposed in vertically reciprocating relation over a lower forming tool 14 with the finish formed workpiece W therebetween. The lower forming tool 14 includes an extraction mechanism 16 for distortion free removal of the formed workpiece W. Extraction pads 18 are provided in recessed portions 20 of the lower forming tool 14 and are simultaneously driven by lift posts 22 and a common lift plate 24 to uniformly strip the delicate workpiece W from a forming surface 26 of the lower forming tool 14.

As best shown in prior art FIG. 7, there is illustrated a tooling apparatus 10' wherein a lateral gap 28' results between an outside surface 30' of a movable forming pad 18' and a vertical surface 32' within a respective recess of a forming tool 14'. The gap 28' may vary in size, but is typically between 0.5 to 2.0 mm. In cases where an insert or forming pad 18' has been press fit into the forming tool surface 14', the gap 28' may be more like a boundary line, but will still produce show-through. Under the high pressures and temperatures of the QPF process, a portion of the formed workpiece W' sags or draws into the gap 28', thereby yielding a show-through depression or valley 34' in an upper surface 36' of the workpiece W', and a draw-in bead 38' projecting beneath a lower surface 40' of the workpiece W.

Such surface discontinuities are unacceptable for production of high quality exterior body panels. Therefore, the show through valley 34' may be treated by sanding a large area of the upper surface 36' of the workpiece W' around and across the show-through valley 34' so as to blend the discontinuity with the rest of the workpiece W'. Unfortunately, however, such blending usually just results in shallower but wider visibly depressed regions. So, show-through may be abated by first filling the valley 34' with a fluid body panel material by hand, then allowing the material to solidify, and finally hand finishing or sanding the material flush with the rest of the upper surface 36' of the workpiece W'. Unfortunately, however, such treatment is labor-intensive, time consuming, and cost-prohibitive. For all intents and purposes, the draw-in of the workpiece W' into the gap 28' results in an effectively unrepairable surface discontinuity in low-cost high-quality production operations.

Thus, the present invention identifies a need for SPF and QPF tooling that does not yield unrepairable show-through surface discontinuities.

SUMMARY OF THE INVENTION

The present invention meets this need by providing an improved apparatus, and related method, for hot blow-forming a sheet metal blank into a finished component. In general, forming tooling is provided having adjacently disposed forming tool elements that define a gap therebetween. A back surface of the sheet metal blank is formed against forming surfaces of the forming tool elements, while an opposite visible surface follows the formed contours of the back surface. The forming tool elements have raised surface features adjacently disposed on either side of the gap to engage and raise the sheet metal along the gap and thereby counteract draw-in or sagging of sheet material into the gap. Raising the sheet metal along the gap facilitates use of a single, subsequent finishing operation for removing the raised sheet metal flush with the rest of the visible surface. The present invention thereby eliminates show-through on the visible surface of the finished component.

In a representative embodiment of the present invention, an apparatus is provided for hot blow-forming an article from a blank of sheet metal wherein one side of the blank becomes a visible surface of the article and a back side of the blank is pushed into contact with a forming surface. The apparatus includes a form tool assembly having the forming surface thereon. The form tool assembly includes a form tool body that partially defines the forming surface and further includes a form tool insert that is positioned substantially flush within a recess of the form tool body and that also partially defines the forming surface. The form tool insert and form tool body collectively define a lateral gap therebetween into which said blank is pushed by blow-forming pressure. Upper surfaces of the form tool insert and form tool body have projections extending upwardly therefrom on either side of the gap. The projections provide resistance to draw-in of the blank into the gap and produce raised portions on the visible surface of the article for a subsequent material removal operation to provide a finish surface not reflective of the gap.

In another representative embodiment of the present invention, a method is provided for producing a sheet metal panel from a blank of sheet metal. The method includes forming a surface of the blank of sheet metal against a form tool body that partially defines a forming surface. Simultaneously, the surface of the blank is formed against a form tool insert that also partially defines the forming surface and that is positioned within a recess of the form tool body such that a lateral gap is defined between the form tool insert and form tool body. Opposed projections are provided on upper surfaces of the form tool insert and the form tool body adjacent the gap, thereby enabling formation of a raised portion on the sheet metal panel that corresponds to the gap. Finally, the raised portion is removed flush with respect to a visible surface of the sheet metal panel.

In contrast to the prior art, the present invention reduces draw-in depth of a workpiece into a gap by about 50% and minimizes the adverse effects of show-through.

BRIEF DESCRIPTION OF THE DRAWINGS

These and other features and advantages of the invention will become apparent upon reading the detailed description in combination with the accompanying drawings, in which.

DESCRIPTION OF THE PREFERRED EMBODIMENT

Figure 7:
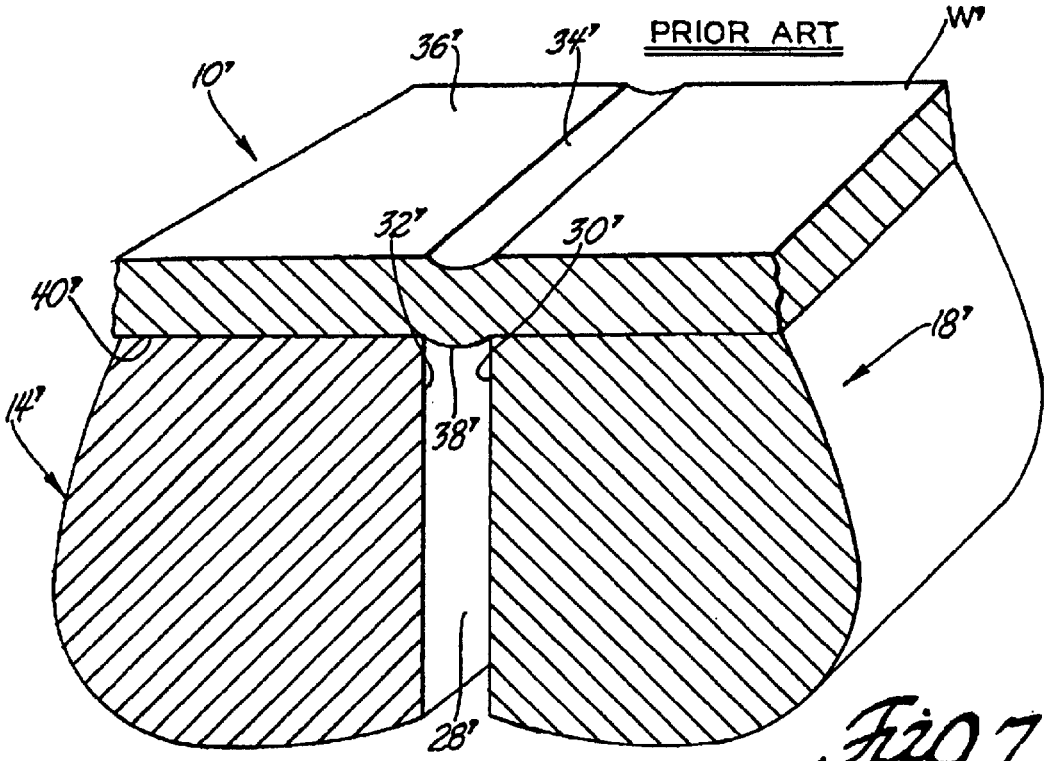
FIG. 7 is an enlarged cross-sectional perspective view of a portion of the workpiece and apparatus of FIG. 6 according to the prior art.
Figure 1:
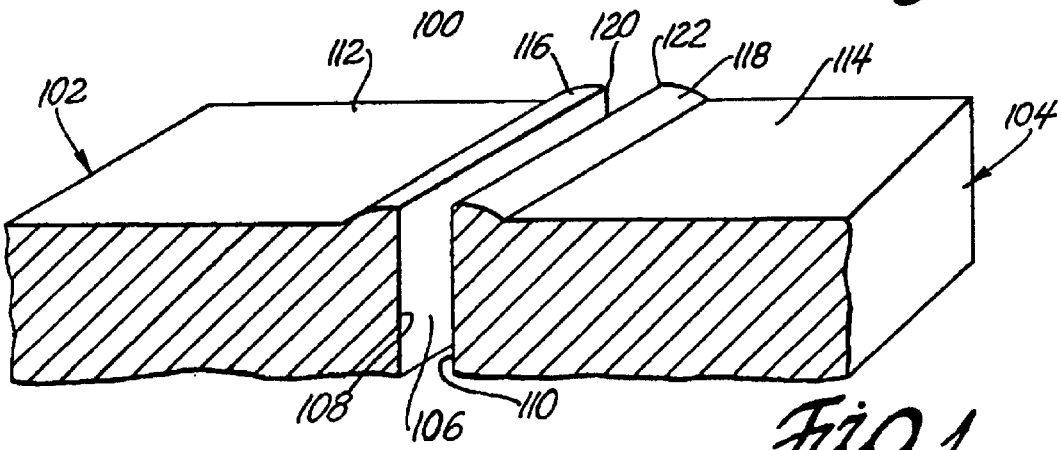
FIG. 1 is a cross-sectioned perspective view of a portion of a hot blow-forming tool according to an embodiment of the present invention.

Referring specifically now to the Figures, there is illustrated in FIG. 1 a portion of a hot blow-forming apparatus 100 in accordance with an embodiment of the present invention. The apparatus 100 includes adjacent or opposing tools in the form of a form tool body 102, and a form tool insert 104 such as a movable ejector pad, or the like. A lateral gap 106 is defined between an interior surface 108 of the body 102 and an exterior surface 110 of the insert 104. A forming surface of the apparatus 100 is collectively defined by an upper surface 112 of the body 102 and by an upper surface 114 of the insert 104. The upper surface 114 of the insert 104 may be substantially flush in height with the upper surface 112 of the body 102 so as to provide a substantially continuous forming surface. To mitigate the draw-in or sagging effect described with respect to the prior art, opposed projections 116, 118 are respectively provided on the body 102 and insert 104 adjacent the gap 106 on either side thereof. The projection 116 may be a continuation of the upper surface 112 of the body 102 and, likewise, the projection 118 may be a continuation of the upper surface 114 of the insert 104.

The projections 116, 118 are designed by first specifying a desired radius for the arc-shaped portions of the projections 116, 118 and then by specifying the location of a center point for the desired radius at a predetermined distance below the respective upper surfaces 112, 114 of the body 102 and insert 104, directly vertically beneath the peaks 120, 122 of the projections 116, 118. Using the projection design dimensions, a material removal operation such as machining, milling, or the like is undertaken to remove material from the body 102 and insert 104, thereby leaving the projections 116, 118. Alternatively, the projections 116, 118 could be formed in any other manner, such as by affirmatively depositing material on the body 102 and insert 104 and machining the material to form the projections 116, 118. In any case, each projection 116, 118 is arc-shaped and respectively includes a peak 120, 122.

Figure 2:
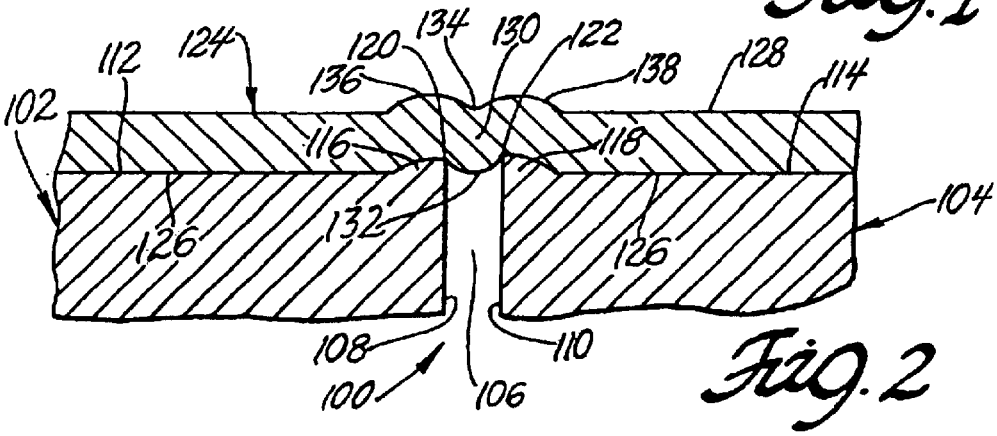
FIG. 2 is a cross-sectioned elevational view of a formed workpiece on the hot blow-forming tool of FIG. 1.

FIG. 2 illustrates a formed workpiece 124 on the hot blow-forming apparatus 100. Here, the formed workpiece 124 has been formed against the apparatus 100 by a hot blow-forming method. The workpiece 124 includes a lower surface 126 that has been formed against the upper surfaces 112, 114 and projections 116, 118 of the body 102 and insert 104. An upper surface 128 of the workpiece 124 closely follows the contours of the lower surface 126. Accordingly, a double-arch portion 130 is created by the projections 116, 118 and is defined by a draw-in bead 132 and a corresponding show-through valley 134 and opposing show-through beads 136, 138 on either side of the valley 134. As will be discussed in more detail below, the shape, width, and height of the projections 116, 118 is predetermined such that the bottom of the valley 134 projects beyond, or is elevated with respect to, the upper surface 128. The draw-in bead 132 does not project below the lower surface 126 of the workpiece 124.

Figure 3:
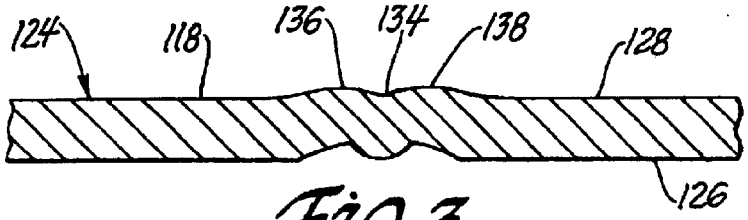
FIG. 3 is a cross-sectioned elevational view of the formed workpiece of FIG. 2.
Figure 4:
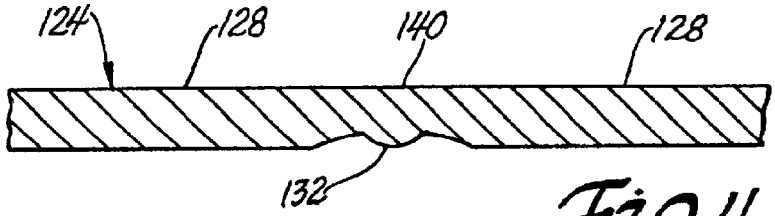
FIG. 4 is a cross-sectioned elevational view of the formed workpiece of FIG. 3, wherein a top surface of the workpiece has been sanded flat.

FIG. 3 illustrates the formed workpiece 124 after having been removed from the tooling and permitted to cool. The workpiece 124 is preferably transported to another workstation where a material removal operation is performed to remove the show-through features 134, 136, 138 flush with the upper surface 128 of the workpiece 124. It is also contemplated that the show-through features 134, 136, 138 as well as the entire upper surface 128, or a large portion thereof surrounding the show-through features 134, 136, 138, could be finished in the material removal operation. The material removal operation may encompass any of a number of processes including milling, sanding, grinding, planing, or the like. As shown in FIG. 4, the material removal operation yields a substantially flat upper surface 128 of the workpiece 124, even across a finished portion 140.

Figure 5:
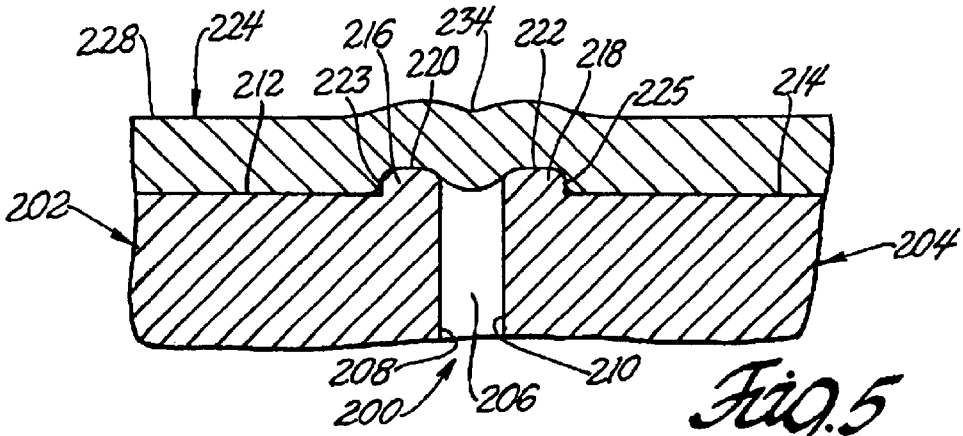
FIG. 5 is a cross-sectioned elevational view of a formed workpiece on a hot blow-forming tool in accordance with another embodiment of the present invention.
Figure 6:
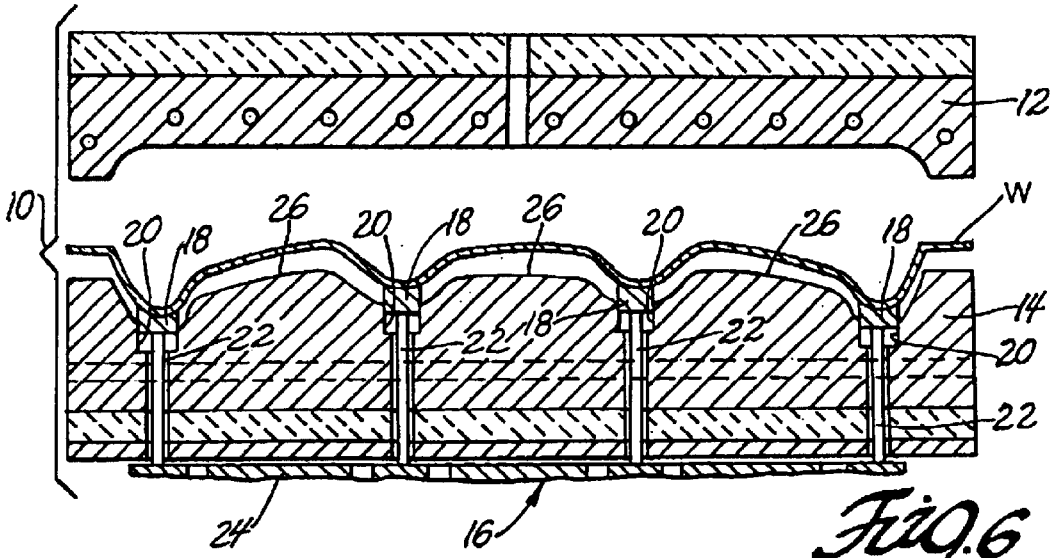
FIG. 6 is cross-sectioned elevational view of a hot blow-forming apparatus and workpiece.

FIG. 5 illustrates a tooling apparatus 200 and a workpiece 224 according to an alternative embodiment of the present invention. The apparatus 200 includes a body 202 and an insert 204 with a gap 206 therebetween defined by opposed vertical surfaces 208, 210 respectively of the body 202 and insert 204. Upper surfaces 212, 214 of the body 202 and insert 204 include opposed projections 216, 218 on either side of the gap 206. Whereas the projections 116, 118 of FIG. 3 are arc-shaped in transverse cross-section, the projections 216, 218 here are rectangular-shaped in transverse cross-section. The projections 216, 218 include top surfaces 220, 222 that establish the height of the projections 216, 218. Preferably, the projections 216, 218 include lip walls 223, 225 that are formed at a suitable draft angle to avoid locking portions of the workpiece 224 thereto. Again, and as will be discussed in more detail below, the shape, width, and height of the projections 216, 218 are predetermined such that the bottom of a show-through valley 234 projects beyond, or is elevated with respect to, an upper surface 228 of the workpiece 224.

In developing the present invention, experiments were conducted to quantify the effects of providing the above-discussed projections on hot blow-forming tooling. The experiments involved tooling composed of P20 steel and AA5083 aluminum sheet material about 0.047" in thickness. Two tests were used in the experiment: one at a tool temperature of 475° C. and 300 psi; and one at 500° C. at 400 psi. All other forming conditions were identical for both tests. The sheet metal blanks were placed in the forming press and preheated for five minutes. The press was then closed and air pressure applied at a rate of 100 psi per minute up to the desired forming pressure. The maximum air pressure was maintained for 1 minute.

The experimental form tooling included two sets of gaps including six prior art gaps without projections and six present invention gaps with projections. Both sets included gap sizes of 0.014", 0.022", 0.038", 0.058", 0.061", and 0.080". Under both tests of the gaps without projections according to the prior art, the workpiece yielded a draw-in bead that sagged into the gaps below the lower surface of the workpiece. Under both tests of the gaps with projections according to the present invention, the workpiece yielded a draw-in bead, but one that did not sag below the lower surface of the workpiece. Rather, the projections produced an arch in the workpiece over the gap, wherein a crown of the arch provided sufficient resistance to pushing of the workpiece material down into the gap.

The workpiece was cross-sectioned and measured for the 0.061" and 0.080" gaps of the prior art and the present invention configurations. It was revealed that the show-through valley of the prior art portion of the workpiece sagged below the upper surface of the workpiece by an amount of 0.003" for the 0.061" gap and 0.005" for the 0.080" gap. In contrast, the show-through valley of the present invention portion of the workpiece did not sag below the upper surface of the workpiece and only sagged below the adjacent show-through beads by an amount of 0.0015" for the 0.061" gap and by an amount of 0.002" for the 0.080" gap. Accordingly, by incorporating the projections of the present invention, it is possible to reduce draw-in depth of a workpiece into a gap by at least 50%.

The optimal shape and size of the projections will vary depending upon the workpiece material, forming conditions, and size of the gap between the tool elements, and some reasonable experimentation will need to be performed on a case-by-case basis for different designs. As an example, however, the 0.080" gap was bounded by opposing projections that were about 0.037" in width and about 0.012" in height. However, further experimentation revealed that the height of the projections could be reduced to as low as 0.007" and still avoid unrepairable draw-in of the workpiece into the gap. The experimentation also revealed that the height of the projections should be kept to a minimum so as to minimize possible damage thereto and to maintain panel thickness. In other words, the higher the projection, the weaker it will tend to be and the higher the show-through beads will be relative to the upper surface of the workpiece. As a result, the panel will be thinner and weaker in the finished area, because the higher the projection, the more the material that needs to be removed to finish the workpiece flush across the upper surface. It is believed that the height of the projections should be less than 50% of the thickness of the workpiece. It was also determined that a typical gap width should be on the order of about 1 to 2 mm, but that lesser or greater widths could also be used. The height of the projection should be based on the gap width and to a lesser degree the thickness of the workpiece. Based on typical QPF forming conditions for aluminum of up to 500° C. and 400 psi, the projection height should be between 1 to 10% of the width of the gap. In gaps of 0.020" or less the height of the projection could be as small as 0.001" however processing of the forming tool usually requires polishing of the surface and a very small projection would be impractical. Projections of no less than 0.004" would be needed and since the typical workpiece is at least 1 mm thick, the strength of the part would not be compromised. If the gap width exceed 150% of the workpiece thickness then the height of the projection should be increased by about 10%.

It should be understood that the invention is not limited to the embodiments that have been illustrated and described herein, but that various changes may be made without departing from the spirit and scope of the invention. Accordingly, it is intended that the invention not be limited to the disclosed embodiments, but that it have the full scope permitted by the language of the following claims.

What is claimed is:

1. Apparatus for hot blow-forming an article from a blank of sheet metal wherein one side of the blank becomes a visible surface of the article and a back side of the blank is pushed into contact with a forming surface, said apparatus comprising a form tool assembly having said forming surface thereon, said form tool assembly including a form tool body at least partially defining said forming surface and further including a form tool insert positioned within said form tool body and at least partially defining said forming surface, said form tool insert and said form tool body defining at least one gap therebetween into which said blank is pushed by blow-forming pressure, said form tool insert and said form tool body having projections on either side of said at least one gap, whereby said projections provide resistance to draw-in of said blank into said at least one gap and produce raised portions on said visible surface of said article for a subsequent material removal operation to provide a finish surface not reflective of said at least one gap.

2. An apparatus as claimed in claim 1, wherein said projections are arc-shaped in cross section.

3. An apparatus as claimed in claim 1, wherein said projections are rectangular-shaped in cross section.

4. An apparatus as claimed in claim 1, wherein said form tool insert is an ejector pad.

5. An apparatus as claimed in claim 1, wherein a ratio of the height of said projections to the thickness of the blank of sheet metal is less than 0.5.

6. An apparatus as claimed in claim 5, wherein said ratio is between 1 to 10% of the width of said at least one gap.

7. Apparatus for hot blow-forming a sheet metal panel from a blank of sheet metal between opposing tools wherein one side of the blank becomes a visible surface of the sheet metal panel and a back side of the blank is pushed into contact with a forming surface, said apparatus comprising at least one of said opposing tools including a form tool assembly having the forming surface thereon, said form tool assembly comprising:

a form tool body at least partially defining said forming surface, said form tool body having at least one recess therein; and at least one form tool insert at least partially defining said forming surface of said form tool assembly and being positioned within said at least one recess of said form tool body, wherein a gap is defined between said at least one form tool insert and said form tool body;

said at least one form tool insert having a projection adjacent said gap that projects beyond said forming surface;

said form tool body having a projection adjacent said gap that projects beyond said forming surface;

wherein said projections of said at least one form tool insert and said form tool body create a raised portion on said sheet metal panel that corresponds to said gap, further wherein said raised portion may be removed flush to said visible surface of said sheet metal panel.

8. An apparatus as claimed in claim 7, wherein said projections are arc-shaped in cross section.

9. An apparatus as claimed in claim 7, wherein said projections are rectangular-shaped in cross section.

10. An apparatus as claimed in claim 7, wherein said form tool insert is an ejector pad.

11. An apparatus as claimed in claim 7, wherein a ratio of the height of said projections to the thickness of the blank of sheet metal is less than 0.5.

12. An apparatus as claimed in claim 11, wherein said ratio is between 1 to 10% of the width of said at least one gap.

13. A method of producing a sheet metal panel from a blank of sheet metal wherein one side of the blank becomes a visible surface of the article and a back side of the blank is pushed into contact with a forming surface, said method comprising:

forming a surface of said blank of sheet metal against a form tool body that at least partially defines a forming surface;

simultaneously forming said surface of said blank of sheet metal against at least one form tool insert that also at least partially defines said forming surface and that is positioned within said form tool body, wherein a gap is defined between said at least one form tool insert and said form tool body;

providing a projection on said at least one form tool insert adjacent said gap that projects beyond said forming surface;

providing a projection on said form tool body that projects beyond said forming surface;

wherein said projections create a raised portion on said sheet metal panel that corresponds to said gap during said forming steps; and removing said raised portion flush to said visible surface of said sheet metal panel.

* * * * *